United States Patent [19]

Ogata et al.

[11] Patent Number: 4,484,205

[45] Date of Patent: Nov. 20, 1984

[54] HEAT-SENSITIVE RECORDING PAPERS

[75] Inventors: Yasuhiro Ogata; Masakazu Maekawa, both of Shizuoka, Japan

[73] Assignee: Fuji Photo Film Co., Ltd., Kanagawa, Japan

[21] Appl. No.: 435,803

[22] Filed: Oct. 21, 1982

[30] Foreign Application Priority Data

Oct. 21, 1981 [JP] Japan ..... 56-168139

[51] Int. Cl.[3] ..... B41M 5/22

[52] U.S. Cl. ..... 346/200; 346/207; 346/226; 428/537.5

[58] Field of Search ..... 282/27.5; 427/150–152; 428/211, 411, 488, 537, 913, 914, 409

[56] References Cited

U.S. PATENT DOCUMENTS 4,168,845 9/1979 Oeda et al. ..... 428/913

FOREIGN PATENT DOCUMENTS 0150395 11/1980 Japan ..... 346/200

*Primary Examiner*—Bruce H. Hess

*Attorney, Agent, or Firm*—Sughrue, Mion, Zinn, Macpeak and Seas

[57] ABSTRACT

A heat-sensitive recording paper for producing recorded images in combination with a thermal head is disclosed. The recording density and resolving power of the image are improved due to the use of a base paper prepared using a pulp having a Canadian standard freeness above 400 cc as the support for the recording paper.

10 Claims, No Drawings

HEAT-SENSITIVE RECORDING PAPERS

FIELD OF THE INVENTION

This invention relates to a heat-sensitive recording paper with improved ability to produce a recorded image in combination with a thermal head.

BACKGROUND OF THE INVENTION

A heat-sensitive recording paper is a recording paper which forms images by utilizing the physical and chemical changes of a material or materials induced by heat energy. Various processes have been investigated involving heat-sensitive recording papers.

Various recording members utilizing physical change or deformation of a material or materials by the action of heat such as the so-called wax-type heat-sensitive recording sheets have been known for a long time. Such materials are utilized for electrocardiograms. Examples of recording members utilizing chemical change by heat include one utilizing coloring or decoloring of a specific compound by heat and one utilizing the coloring reaction of two or more materials by the action of heat.

Examples of recording members utilizing the coloring reaction of two or more materials by heat include those involving a combination of a ferric salt of a higher fatty acid such as stearic acid and a polyhydric hydroxyaromatic compound (U.S. Pat. No. 2,663,654, 2,663,655, 2,663,656, 2,663,657, etc.), a recording member for forming azo dyes, oxazine dyes, etc., from dye-forming materials (Japanese Patent Publication No. 9240/63, etc.), and a combination of a colorless dye such as Crystal Violet lactone, and a phenol compound (U.S. Pat. No. 3,539,375).

These heat-sensitive recording papers involve first order coloration, i.e., they do not require development. Therefore, the recording means can be made light weight and miniaturized. These factors have recently made such recording paper desirable to utilize. However, such heat-sensitive recording paper cannot record at sufficiently high speeds. This is due to a limitation on the response speed of the recording element which utilizes heat energy. Various efforts have been made to improve the response speed by modifying both the recording apparatus and the recording paper. One effort involves increasing the smoothness of the surface of the heat-sensitive recording paper (as described in Japanese Patent Publication No. 20142/77 and Japanese Patent Application (OPI) No. 47351/73 (the term "OPI" as used herein refers to a "published unexamined Japanese patent application")). In general, the smoothness of a heat-sensitive recording paper is increased by surface treatment such as super calendering, etc., whereby the heat transfer efficiency between the recording element and a heat-sensitive recording paper is improved which improves the recording speed.

However, improving the smoothness by such a surface treatment is accompanied by various faults. One of these faults is the occurrence of fog, that is, the occurrence of a coloring reaction in the surface treatment step, coloring the recording paper. Another method to increase response speed involves the addition of a granular wax as proposed in Japanese Patent Publication No. 14531/75. However, the wax generally has a large heat capacity and heat of fusion, which results in reducing the response time.

Another disadvantage of increasing smoothness is reduction in writability of the paper with a pencil, a ball point pen, etc. The reason for the reduced writability can be understood by considering that the action of these writing means depends on friction with the paper.

Still another disadvantage involves a problem on production step because there is a great reduction in the production efficiency since super calendering is performed by a separate machine.

When super calendering is carried out, the density of a heat-sensitive coloring layer is greatly increased. Accordingly, the dispersion of a heat-fusible material fused by a heat energy at recording is reduced forming adhesion between the recording element and the recording paper at the coloring portion. This reduces the running property of the recording element.

In spite of these faults, the surface treatment to increase the smoothness of a recording paper is presently performed since improving smoothness has a relatively large contribution with respect to improving response speed.

Japanese Patent Application (OPI) No. 24191/81 discloses a method reducing the base paper's beating extent below 250 cc (CSF) and increasing the bulk density above 0.9 by super calendering but the method is still insufficient to improve the recording speed, running property, and staining of head.

SUMMARY OF THE INVENTION

A primary object of this invention is to provide a heat-sensitive recording paper giving high heat transfer efficiency between the recording element and the recording paper without being accompanied by the aforesaid faults.

The objects of this invention are attained by the heat-sensitive recording paper of this invention comprising a base paper prepared by a pulp having a Canadian standard freeness (JIS, P8121) of 400 cc or more and a heat-sensitive color forming layer formed on a surface thereof.

DETAILED DESCRIPTION OF THE INVENTION

The support base paper used in this invention is produced from a pulp treated to a Canadian standard freeness (Japanese Industrial Standard, JIS, P8121) of 400 cc or more, preferably 450 to 750 cc; more preferably 480 to 750 cc. The density of the base paper which is used in connection with this invention is preferably 0.9 or less g/cm$^3$, more preferably 0.4 to 0.9 g/cm$^3$.

By using the specifically disclosed support of the present invention, the permeation of the coating composition for the heat-sensitive color forming layer into the support is astonishingly reduced. Accordingly, the amount of the coloring component existing on the surface of the coated layer is increased.

By using the support in this invention, the sensitivity and the colored image density of the recording material can be increased. Furthermore, the resolving power can be increased and a clear colored image can be obtained at a high recording speed.

When the beating extent is less than 400 cc, the sensitivity and colored images are insufficient and hence the objects of this invention cannot be attained.

In the present invention, a base paper produced from an unbeaten pulp can also be used, and an excellent sensitivity as well as excellent colored images and resolving power are unexpectedly obtained by using such a base paper for a heat-sensitive recording paper. Generally, the Canadian standard freeness of unbeaten pulp is 550 to 750 cc.

A subbing layer may be formed on the base paper. The subbing layer is comprised of a water-soluble binder such as a starch and PVA or a water repelling agent such as a latex, e.g., SBR and a styrene-maleic anhydride copolymer alkyl ester. The subbing layer is formed by surface sizing such as size pressing or coating. The base paper may be treated by a calender or a super calender.

The pulp used in producing the paper of this invention may be a wood pulp, or a mixture of a wood pulp and a synthetic pulp. The examples of the wood pulp include LBKP, LBSP, NBKP, NBSP, esparto, cotton, hemp, bamboo, flax, etc., and the examples of the synthetic pulp include polyethylene, rayon, nylon, etc.

The pulp may also contain a sizing agent such as rosin, alkylketene dimer, alkenylsuccinic acid, or a filler scuh as clay, talc or calcium carbonate. The sizing agent is used in an amount of 0.1 to 5% by weight based on the weight of the pulp in order to control the hydrophilic property of the cellulose. It is also possible to add a paper strength increasing agent such as polyacrylamide or starch.

The coating composition for the heat-sensitive recording layer is a dispersion of fine particles of heat-sensitive color forming materials in a water as a dispersing medium. A practical example is a dispersion of fine particles less than a few microns in size of an electron donating colorless dye such as Crystal Violet lactone and an electron accepting compound such as 2,2-bis(4-hydroxyphenyl)propane in an aqueous solution of polyvinyl alcohol. Methods of producing these coating compositions are described in U.S. Pat. No. 3,539,375, Japanese Patent Application (OPI) Nos. 93492/80, 14281/80, etc. It is preferred that the mean particle size of the particles dispersed in the coating composition is less than 8 μm, particularly less than 4 μm. This particle size is preferred because the heat-sensitive color forming layer is usually coated to a thickness of 5 to 10 μm. Therefore, if the coating composition contains coarse particles, sufficient smoothness cannot be obtained.

The invention will be explained by the following example although the invention is not limited to it.

EXAMPLE

A mixture of 20 kg of Crystal Violet lactone and an aqueous solution of 10% polyvinyl alcohol (saponification value: 98%, polymerization degree: 500) was dispersed for 24 hours in a 300 liter ball mill. Similarly, a mixture of 20 kg of 2,2-bis(4-hydroxyphenyl)propane and an aqueous 10% polyvinyl alcohol was dispersed for 24 hours in a 300 liter ball mill. These dispersions were mixed with each other so that the ratio of Crystal Violet lactone to 2,2-bis(4-hydroxyphenyl)propane became 1:5 by weight ratio and further 5 kg of calcium carbonate was sufficiently dispersed in 20 kg of the mixture solution to provide a coating composition.

As a pulp, 30 parts of NBKP and 70 parts of LBKP were used and after adding 1% rosin and 2% aluminum sulfate to the pulp, the mixture was beaten to the beaten extent (CSF) as shown in Table 1 to provide a base of 50 g/m$^2$.

The foregoing coating composition was coated on the base paper at a coverage of 6 g/m$^2$ by means of an air knife coater to provide a heat-sensitive recording paper of this invention. Using the heat-sensitive recording paper, recording was performed by applying an energy of 2 ms/dot and 50 mj/mm$^2$ to the recording element at a density of main scanning of 5 dots/mm and side scanning of 6 dots/mm. The reflection density at 610 nm (the maximum absorption wavelength of the colored material of Crystal Violet lactone) was then measured.

Comparison examples were performed by repeating the same test as in the example except that commercially available wood free papers were used as the support for the heat-sensitive recording papers.

The results obtained are shown in Table 1. The results clearly show that the heat-sensitive recording papers of this invention have very good recording characteristics.

TABLE 1

| | Base Paper | | | | |
|---|---|---|---|---|---|
| | Beating Extent (CSF) (cc) | Smoothness (sec.) | Coated Paper Smoothness (sec.) | Recording Density | Resolving* Power |
| Invention 1 | 620 | 40 | 60 | 1.25 | Good |
| Invention 2 | 550 | 60 | 60 | 1.21 | Good |
| Invention 3 | 420 | 50 | 70 | 1.23 | Good |
| Comparison Example 1 | 350 | 120 | 100 | 0.85 | Poor |
| Comparison Example 2 | 200 | 160 | 90 | 0.73 | Poor |
| Comparison Example 3 | 170 | 200 | 120 | 0.80 | Poor |

*The resolving power was evaluated by visually observing the image quality.

It is particularly astonishing that when using the base papers of this invention, excellent recording density and resolving power can be obtained, even though the smoothness of the paper of this invention is lower than the comparison examples.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording paper, comprising:

a support base paper comprised of pulp having a Canadian standard freeness (JIS, P8121) of 400 cc or more; and a heat-sensitive color forming layer formed on a surface of the support base paper, the color forming layer comprising an electron donating colorless dye and an electron accepting compound.

2. A heat-sensitive recording paper as claimed in claim 1, further comprising:

a subbing layer positioned between the support base paper and the heat-sensitive color forming layer.

3. A heat-sensitive recording paper as claimed in claim 2, wherein the subbing layer is comprised of a water-soluble binder.

4. A heat-sensitive recording paper as claimed in claim 2, wherein the subbing layer is comprised of water repelling agent selected from the group consisting of latex and a styrene-maleic anhydride copolymer alkyl ester.

5. A heat-sensitive recording paper as claimed in claim 1, wherein the base paper is treated by a super calender.

6. A heat-sensitive recording paper as claimed in claim 1, wherein the heat-sensitive color forming layer is comprised of a dispersion containing particles having a mean particle size of 8 μm or less.

7. A heat-sensitive recording paper as claimed in claim 6, wherein the particles have a mean particle size of 4μ or less.

8. A heat-sensitive recording paper as claimed in claim 1, wherein the heat-sensitive color forming layer has a thickness within the range of 5 to 10 μm.

9. A heat-sensitive recording paper as claimed in claim 1, wherein the base paper is comprised of a wood pulp.

10. A heat-sensitive recording paper as claimed in claim 1, wherein the base paper is comprised of a mixture of wood pulp and synthetic pulp.

* * * * *